United States Patent [19]

Anderson

[11] 3,959,981

[45] June 1, 1976

[54] APPARATUS FOR PREPARING ICE

[76] Inventor: Luzon L. Anderson, 257 Merwin Drive, Norristown, Pa. 19401

[22] Filed: Aug. 8, 1974

[21] Appl. No.: 495,685

[52] U.S. Cl. ..... 62/135; 62/70; 62/356

[51] Int. Cl.[2] ..... F25C 1/10

[58] Field of Search ..... 62/135, 356, 352, 69, 62/70, 308, 430, 64

[56] References Cited

UNITED STATES PATENTS

| | | | |
|---|---|---|---|
| 1,130,440 | 3/1915 | Shipley | 62/349 X |
| 1,322,660 | 11/1919 | Voorhees | 62/356 X |
| 1,348,352 | 8/1920 | Edwards | 62/66 |
| 1,745,751 | 2/1930 | Folc | 62/356 X |
| 1,925,616 | 9/1933 | Velut | 62/356 X |
| 1,997,341 | 4/1935 | Perman | 62/349 X |
| 2,414,264 | 1/1947 | Kirkpatrick | 62/349 X |
| 2,496,155 | 1/1950 | Folkerson | 62/356 X |
| 2,710,126 | 6/1955 | Hughes | 62/349 X |
| 2,763,416 | 9/1956 | Wormser | 62/349 X |
| 2,768,507 | 10/1956 | Hoen | 62/356 X |
| 2,959,026 | 11/1960 | Swanson | 62/348 X |

*Primary Examiner*—William E. Wayner
*Assistant Examiner*—William E. Tapolcai, Jr.
*Attorney, Agent, or Firm*—Frank J. Benasutti Associates

[57] ABSTRACT

Refrigerant is cooled under atmospheric pressure and ambient temperature to a temperature below that of the freezing point of water under atmospheric conditions and is then passed through an automated plant for making cans of ice and an ice storage facility. The plant includes machinery for automatically filling ice making cans and discharging the ice from the cans once it is formed.

4 Claims, 4 Drawing Figures

APPARATUS FOR PREPARING ICE

BACKGROUND OF THE INVENTION

This invention relates generally to the ice making art, and more particularly, to a method and apparatus utilizing atmospheric conditions to make ice.

In the prior art, the conventional way of making ice is to use a brine tank and circulate a refrigerant through coils submerged in the brine. Containers known as ice cans are filled with water and then lowered into the brine until frozen. These containers are rectangular in shape and tapered inwardly from top to bottom to permit easy removal of the ice from the can and to prevent rupture of the can when the water freezes. These cans are filled with approximately 315 pounds of water to a level of about three or four inches from the top to prevent spilling of the water and to prevent the brine water from spilling into the cans when the cans are lowered into the brine tank. An air hose is submerged about one half of the depth of the water in the ice can to agitate it to cause it to freeze faster. The water freezes from the bottom up and from the outer sides of the can toward the center. When it is about two thirds frozen, the air hose is removed and the rest of the water is permitted to freeze.

It is also known that water does not freeze when it is cooled down to 32°F, but rather an additional amount of heat must be removed before there is a change of state. Specifically, 144 BTU's (British thermal units) per pound must be removed before there is a change of state from liquid to solid. The same amount of heat, 144 BTU's, must be added to change ice to water without changing the temperature. Therefore, for every pound of ice at 32°F there are 144 BTU's cooling effect. If ice could be used in, for example, chilled water systems, this cooling effect from the ice would be an available energy source, over and above that cooling effect which is normally available in the usual cooling system which requires a separate energy source to reduce the temperature of the cooling media. Not only would the 144 BTU's per pound be recovered as the ice melts into water, but also the water so produced would be at 32°F and would provide an additional cooling effect by virtue of the differential in temperature between it and the discharge water in the cooling system.

Electric generating power houses use thousands of tons of water daily in the condensers for converting steam back to water in order to pump the demineralized water back into the boiler. The cooling water returns to a stream or river after it has passed through the condenser at much higher temperatures than the river water, creating thermal pollution and often killing marine life. Some power houses also use huge cooling towers which stand several hundred feet into the air, creating a natural draft to cool the condenser water to a temperature low enough to be legally returned to the stream or river, and in some cases recycled through the condenser. These huge cooling towers admit a great amount of heat and tons of vapor causing thermal pollution of the air and loss of the much needed water at a time of the year when water is most needed; and the thermal pollution adds to the heat and humidity at a time of year it is least needed. During the hot summer months there will be little cooling effect of cooling water when it reaches the power house due to the amount of heat the water was exposed to in atmospheric conditions. Such water is typically taken from rivers and streams which are at their lowest during the summer months. This water is also returned to the streams and rivers. Thus the cooling effect for each pound of water will be minimal.

In most all sections of the world today there is an energy shortage, and in many sections there are water shortages in the summer months with high thermal pollution of the air and rivers.

SUMMARY OF THE INVENTION

Utilizing nature by making ice in the winter months and storing it for use in the summer months will make a great contribution toward solving four problems: less energy used; more water available when it is needed most; less thermal pollution of the air; and less thermal pollution of the streams. Industrial and commercial consumers can profit by using ice made in the winter months and improve the environment for all who live and work around these business establishments. By utilizing the weather, ice may be made in any section of the country or at any location where the temperature falls below 32°F for a period of time long enough to freeze water. In accordance with the preferred embodiment of my invention, I provide a means for exposing a refrigerant to atmospheric temperatures and pressures, and reducing the temperature of that refrigerant sufficiently to freeze water. The refrigerant is pumped through a jacketed can into which has been placed a sufficient quantity of water for the purposes of making ice. When the ice is frozen it is ejected from the can and the can is refilled. The ejected ice is transmitted by a conveyor belt to a storage area. The storage area is also cooled by the refrigerant. In ejecting the ice it is necessary to raise the temperature of the can sufficient to cause a parting between the can and the ice. To do this, I provide a means for supplying refrigerant at an elevated temperature as compared to the cooled refrigerant used for freezing. This supply of higher temperature refrigerant is pumped through the jacket of the ice can. In the description which follows and in the drawings, there is disclosed an automated plant for accomplishing the above ends.

Accordingly, it is an object of my invention to provide a new and novel apparatus and method for the making and storing of ice automatically under atmospheric conditions. This and other objects of my invention will become apparent from the following description with reference to the accompanying drawings.

DESCRIPTION OF THE PREFERRED EMBODIMENT

Figure 1:
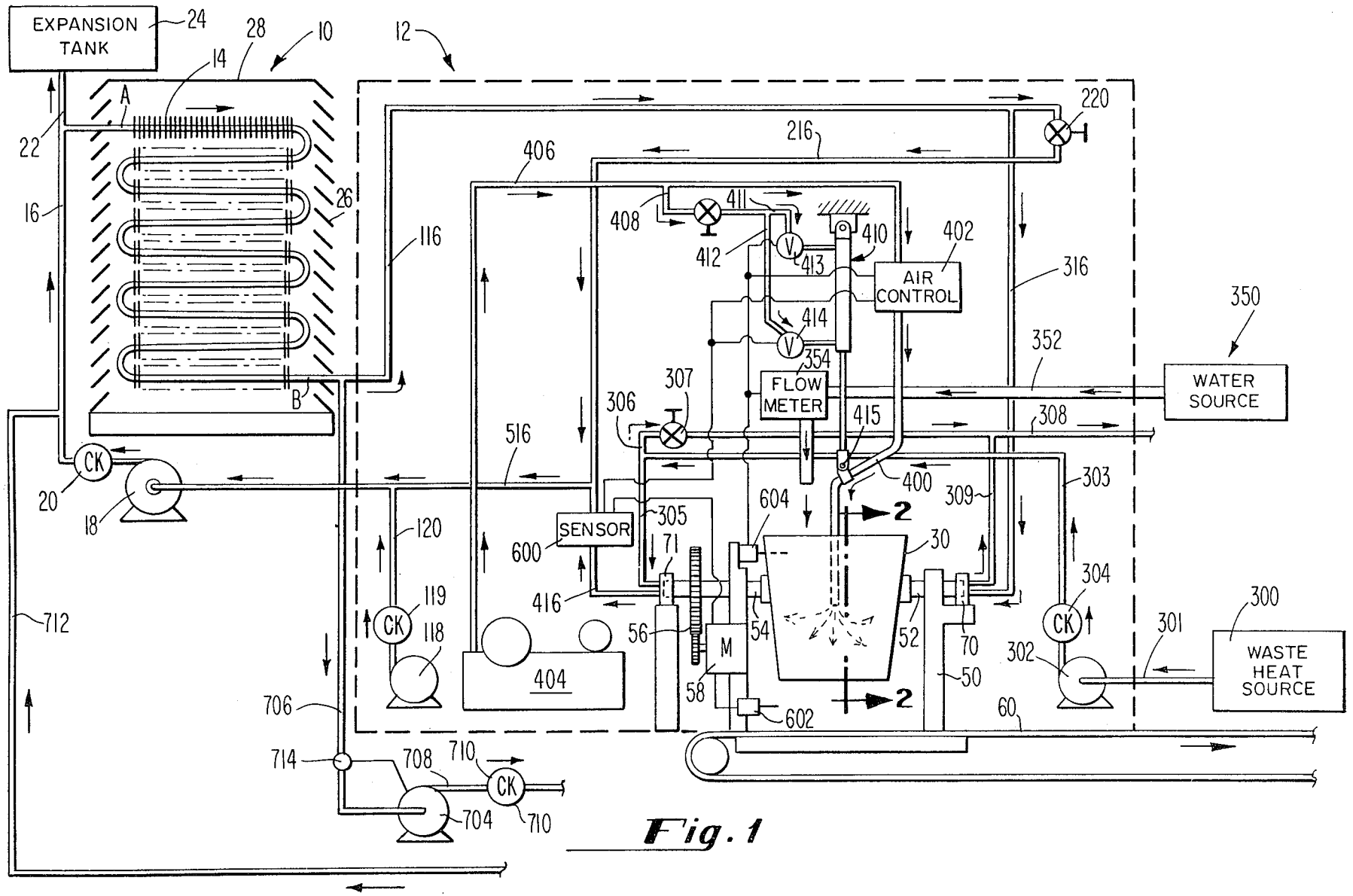
FIG. 1 is a diagram showing a portion of the apparatus in accordance with the preferred embodiment of my invention.

Although specific forms of the invention have been selected for illustration in the drawings, and the following description is drawn in specific terms for the purpose of describing these forms of the invention, this description is not intended to limit the scope of the invention which is defined in the appended claims.

Referring to FIG. 1, the preferred embodiment of my invention as shown in diagramatic form comprises a cooling tower designated generally 10 and an ice plant designated generally 12. The cooling tower is used to reduce the temperature of the refrigerant under atmospheric conditions. The refrigerant may be any type of antifreeze, glycol or any other liquid that will not freeze at extremely low temperatures and which may be used as a refrigerant. The cooling tower, spray ponds, or fin cooling units may be used in accordance with my invention, but in this embodiment a large outdoor fin coiled radiation unit (which may be installed horizontally or vertically) is used to reduce the temperature of the refrigerant. This comprises a plurality of fin coils one of which is shown at 14, mounted in such a way within the tower that air may pass over the fins and thereby remove heat (BTU's). The refrigerant is pumped through the conduit 16 by means of the pump 18. A check valve is provided at 20 to prevent the return of fluid through the conduit. A branch line 22 extends from the conduit to an expansion tank 24 used for the usual purposes. Cooling towers are, of course, well known in the art. It is preferable, however, in this case, which contemplates a closed system, that the cooling tower be such as to protect the coils from direct contact with rain, sleet or snow. To this end, the fin coils are surrounded by an open structure comprising side walls which are vented as illustrated at 26. The closed cooling system has several advantages. For one, there is less pollution caused by dust and particles from the air and for another there is less dilution of the refrigerant. In any event, the coils must be located where air can freely flow over the coils, such a location being preferably on the tops of towers, roofs of tall buildings or other locations which have high elevations, such as hills. The tower is topped by a roof 28 to protect the coils from icing by freezing rain, sleet or wet snow which would normally render them less efficient. The roof is vented to prevent trapping of heat.

Given the right atmospheric conditions, the refrigerant enters at a higher temperature at point A and exits at a lower temperature at point B. It should be emphasized that this system is only designed to be used during the winter months in most areas of the world, or during such additional months as will allow the temperature of the refrigerant to be brought down below the temperature of water when it is subject to being frozen under atmospheric conditions at that place and time. This is not to say that this apparatus and the method disclosed herein could not be adapted to other conditions within the scope of this invention, but merely to point out that it is the preferred embodiment which is now being described.

Figure 2:
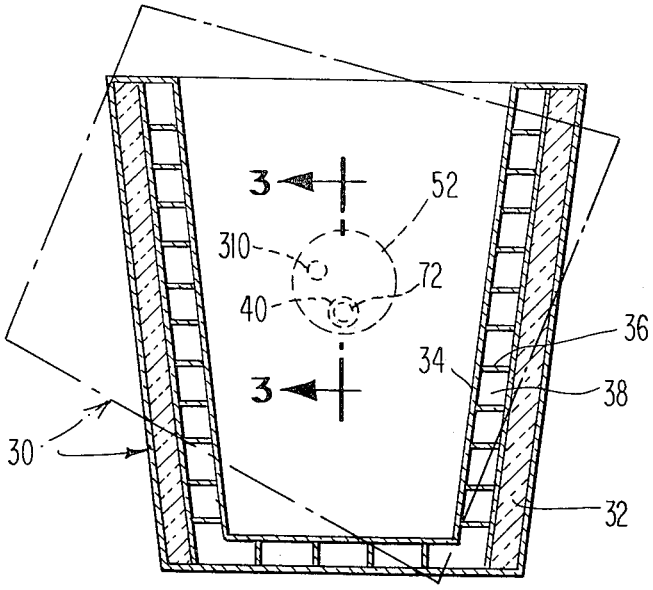
FIG. 2 is a section taken along the lines 2—2 in FIG. 1, showing a portion of the apparatus with an alternate position of the portion shown in phantom lines.
Figure 3:
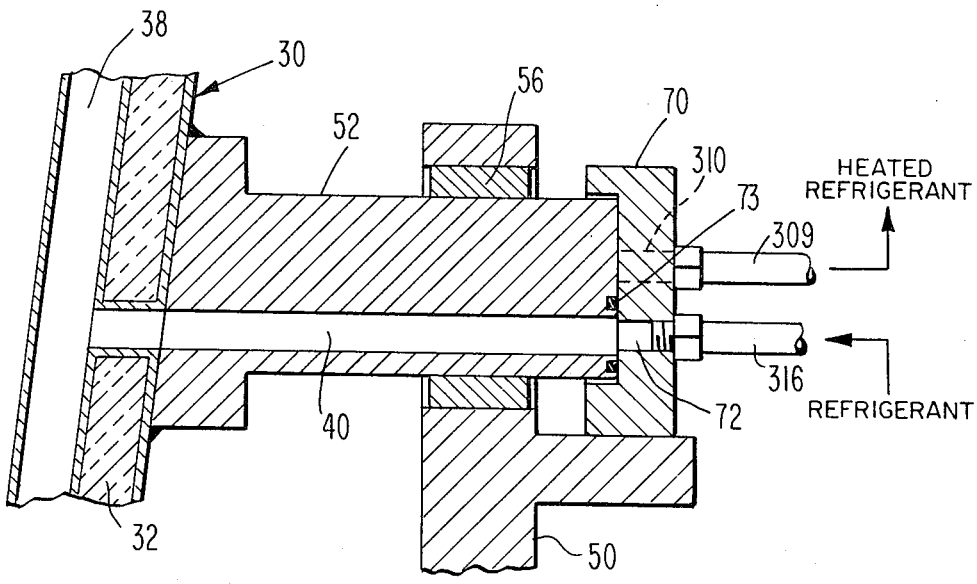
FIG. 3 is a greatly enlarged section taken as indicated by the lines 3—3 in FIG. 2.

In accordance with this preferred embodiment, a faster and more efficient method of freezing large quantities of water, than that described above as a conventional method, is used. The ice making plant 12 contains banks of jacketed ice cans, a typical one of which is shown at 30. This ice can is shown in greater detail in FIG. 2 and comprises a tapered bucket having insulated walls at 32 spaced from an inner container 34 by a plurality of fins, one of which is shown at 36. These fins or baffles are used to direct the flow of refrigerant in a manner that will achieve the best cooling results. They preferably do not extend completely circumferentially. The fins are disposed in a chamber between the wall of the inner bucket and the wall which is insulated. This chamber 38 is in fluid flow communication with a conduit line 40 in the refrigerant flow system as shown in FIG. 3. Thus, refrigerant is introduced into the chamber.

Referring again to FIG. 1, each of the jacketed ice cans is mounted on a stand such as that shown at 50, so that it hangs upright to be filled with water during the freezing process. Trunnions are provided as at 52,54 to support the bucket on the stand. As shown in FIG. 3, the trunnion 52 is mounted in the bearing 56 and it will be understood that a similar bearing is provided for the trunnion 54. Thus, there is provided pivotable supports.

When the water in the can is completely frozen, the can is pivoted through an arc of approximately 112 ½°. In this position, the ice is released in the manner to be more fully described hereinafter. In order to pivot the can, a gear mechanism, such as that shown at 56, can be provided attached to the trunnion, such as the trunnion 54, and controlled by the motor 58. It will be understood that the motor is reversible, so that the can can be returned to its upright position after release of the ice.

In order to effect the release of the ice from the can, a warm refrigerant can be pumped through the cavity 38 to raise the temperature of the inner wall proximate to the ice. When this is sufficiently warm the ice will separate from the container and because of the tapered shape of the container and angle of inclination shown in the phantom view in FIG. 2, the ice will slide from the container. A conveyor is shown at 60 in FIG. 1. This conveyor is positiond so that the ice will be deposited directly onto it and it will transmit the ice in the direction of the arrow shown to a storage area designated generally 700 in FIG. 4.

Referring again to FIG. 1, note that the refrigerant exits at B from the cooling tower in the direction of the arrow through conduit 116. This conduit divides into a bypass line 216 controlled by a valve 220 and a feed line 316. The feed line 316 terminates in FIG. 3 in a fitting attached to a ring 70. The ring is mounted on the support 50 and has a plurality of holes passing through it. The hole or passageway 72, which is in fluid flow communication with the conduit 316, is disposed to be aligned with the passage 40 through the trunnion 52 when the ice bucket is in the upright position shown in FIGS. 1 and 2. Note the positions of the passages 40 and 72 shown in FIG. 2 in dotted lines. It will be understood that a similar ring and passage connection through the trunnion 54 is provided for example by the ring 71 so that the refrigerant will pass through the passages 72 and 40 into the chamber 38, out of the chamber 38, through the trunnion 54 and ring 71 and into the conduit 416, FIG. 1. From there, the refrigerant will be returned by the line 516 to the refrigerant pump 18.

Note that there is a refrigerant makeup pump at 118 and check valve 119 and feed line 120 to supply makeup refrigerant from a source (not shown) to the return line 516.

The pumping of the cold refrigerant from the cooling tower through the chambered ice can and back to the cooling tower provides in part the means for freezing the water. To release the ice, however, a separate source of refrigerant is provided. This source (not shown) feeds refrigerant through a waste heat source 300 which can be any source of heat in suitable capacity around the plant. For example, a refrigerant coil may be submerged in the water source 350 raising the temperature of the refrigerant and lowering the temperature of the water near the freezing point. This separate source heats the refrigerant to a temperature above the freezing point of water, and that refrigerant is pumped from the source through the conduit 301 by the pump 302 and through the conduit 303, and the check valve 304, to a main branch line 305. A bypass line is shown at 306, controlled by valve 307 and communicating with discharge line 308. Valve 307 is a control valve that performs the same function as valve 220. When the can is in the fill and freezing position and the warm refrigerant is blocked by the ring 71, valve 307 opens to permit liquid flow through line 306 and line 308 thereby preventing overloading of pump 302. Valves 220 and 307 are control valves for the purpose of by-passing the refrigerant and preventing pump and motor overload when the ice cans are in a position that will restrict the flow of either system. The main branch line 305 communicates through the ring 71 in much the same way as that previously described with respect to the line 316 and the disc or ring 70. The difference is that the heated refrigerant lines communicate at a different point with the rings 70 and 71. Accordingly, they are normally closed off when the ice cans are in the upright position shown in FIGS. 1 and 2. Note, for example, in FIG. 3 that the exit line 309 for the heated refrigerant which is in fluid flow communication with a hole 310 forming a passage through the ring 70, cannot receive fluid since it is blocked by the trunnion 52. However, when the can is pivoted 112 ½° to the position shown in phantom lines in FIG. 2, the hole forming the exit of the conduit 40 will line up with the hole forming the entrance to the passage 310. Note that an O-ring or similar seal 73 is provided so that there is no leakage in the slip joint. Thus, in the position shown in phantom lines, the jacketed ice can can receive warm fluid from the line 305 through the trunnion 54 into the chamber 38, and this fluid will flow through the passage 40 and trunnion 52 and out through the passage 310 and conduit 309 to the discharge line 308 through which it will travel back to the source (not shown). In so doing, it will heat the inner wall of the bucket to release the ice. However, it will be noticed that the temperature differential will be small and that the fluid remaining in the chamber 38 will be the same type of fluid in both heating and freezing, namely, the refrigerant.

Two other ingredients are generally necessary in this process. One is water and the other is air. The water is supplied from a source (designated generally 350 or otherwise not shown) and flows through a conduit 352 under suitable pressure through a flow metering device 354 and is discharged in the direction of the arrows shown into the open end of the ice container. The amount of water introduced in any given shot or fill-up of the container is controlled in a conventional manner by the flow metering device illustrated at 354.

The air is introduced under suitable pressure through a flexible conduit 400. This air passes through an air control valve 402 which is connected to a compressor 404 by means of conduit 406. A branch line 408 supplies air to a double acting piston and cylinder arrangement designated generally 410 through lines 411 and 412. Control valves 413 and 414 control the flow of air, as will be more fully described hereinafter.

The piston is connected in any suitable fashion, as by means of the pivoted joint 415, to the flexible air supply line 400.

The control system for operating this equipment comprises, among other things, a temperature sensing means for sensing when the water has reached the proper frozen state so that the ice making can can be inverted for discharge of the ice in a solid block, and various control means for regulating the position of the can, the flow of water and the positioning of the air hose and the flow of air through it. In the embodiment shown, a temperature sensing device 600 is provided in line 416, which is the refrigerant line exiting from the can. As shown schematically, the sensor 600 controls the motor 58 so that when the appropriate temperature has been reached, the motor will be actuated to pivot the can to the position shown in phantom lines in FIG. 2. Since the warm refrigerant flows through the jacketed can in this position, the ice will be released and when it exits from the can it will contact a sensor 602 which in turn controls the motor 58 to return the can to its upright position.

In the upright position, the can 30 will contact the sensor 604 to actuate the flow meter 354 and allow a measured amount of water to flow into the open can.

Also involved in the ice making cycle, is a provision for inserting the hose 400 and regulating the air emanating from it. The position of the air hose is controlled by the piston and cylinder 410 in response to signals from sensor 604 and sensor 600. The amount of air is controlled by the air controller 402 in response to signals from the sensor 600 and the sensor 604. For example, when the temperature of the exiting refrigerant during the freezing cycle is sensed to be the temperature at which the ice is partially frozen so that the air hose can be withdrawn, the signal will be transmitted from the sensor 600 to the air controller 402 to close off the flow of air and the signal will be provided from the sensor 600 to the control valve 414 to withdraw the piston and with it the hose 400. The freezing cycle is thereafter completed. A preset timing device, or a temperature and timing device, may be installed to provide the time required to freeze the remaining one-third water before the can is pivoted to the emptying position. The ice is dumped and the can returns to its upright position, wherein it engages the sensor 604. The signal is then sent to the valve 413 to move the piston downwardly so that the hose 400 is inserted into the can and a signal is sent to the air controller so that air starts flowing through the hose 400.

Of course, other types of control devices could be utilized within the scope of this invention and it has been my desire here to present only an embodiment which would illustrate technologically the way of automating the ice making system.

Figure 4:
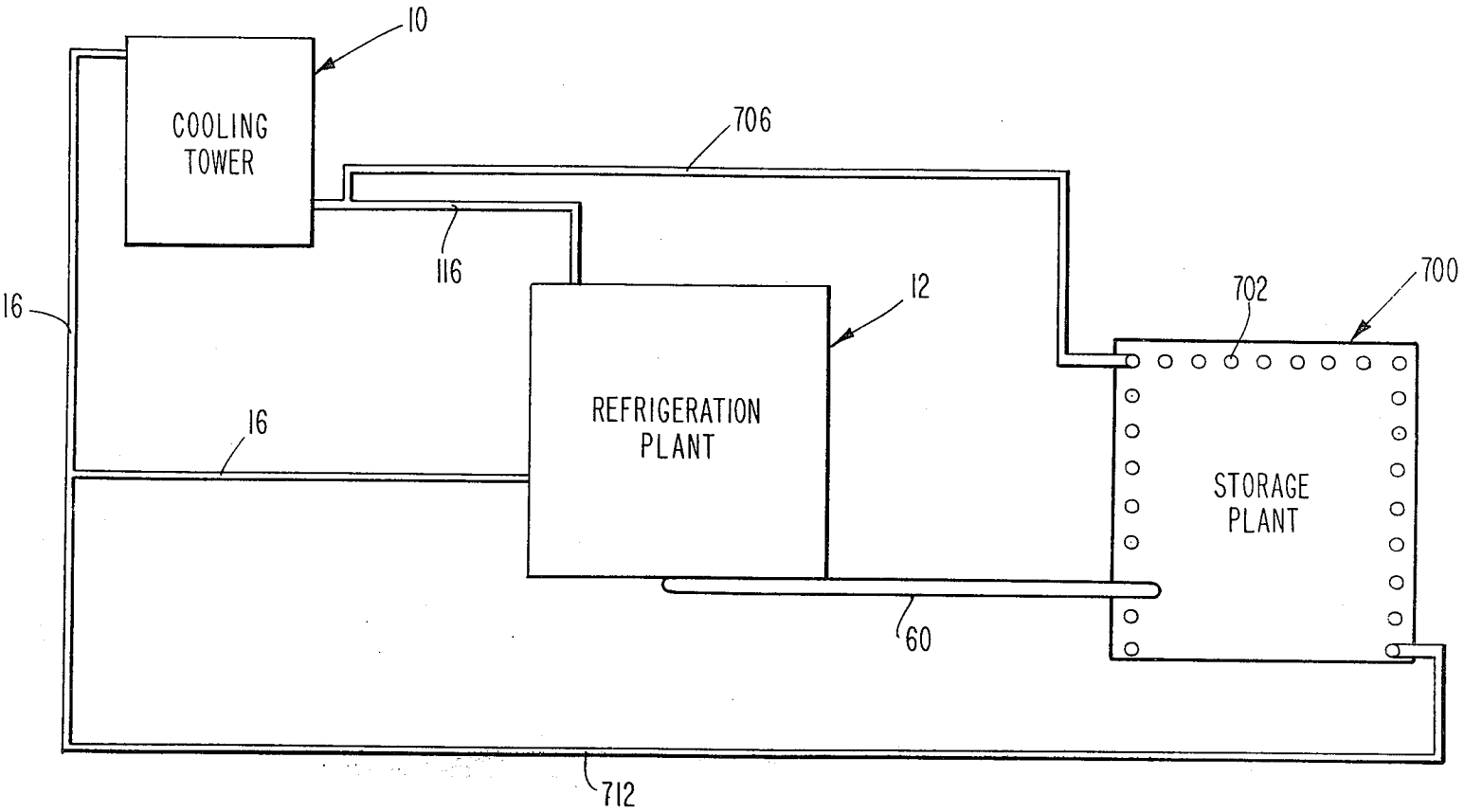
FIG. 4 is a diagram showing the overall apparatus.

Refrigerant from the cooling tower 10 should be circulated through the finned coils 702 installed in the side walls and ceiling of the storage plant 700, FIG. 4. This should be done at the beginning of the ice making season so that the temperature inside the storage area is lowered well below the freezing point before the storing of any ice in the storage house. A pump 704 with a suction branch line 706 off of line 116 near the base of the cooling tower discharge is used to circulate refrigerant through the coils 702 in the storage area. The discharge line 708 from the pump to the fin coils in the cold storage area has a check valve 710 in it. The return line 712 from the fin coils in the cold storage area communicates with line 16 downstream of the check valve 20. A sensor 714 in the line 706 is connected to the pump 704 to stop the pump when the temperature of the refrigerant in the line 706 rises above 32°F.

It will be apparent to one skilled in the art that various changes can be made in the system which has been described above within the scope of the invention. It should also be apparent from this description that many advantages can flow from utilizing this system where weather conditions permit. For example, in conventional ice making systems, the temperature is kept just above the freezing point of brine, about 27°F. This requires a much longer period of time for ice to freeze than would be posible with the much lower temperatures that could be accomplished with this system. Furthermore, it is possible to control temperatures and greatly reduce heat loss in operations such as the warming of the jacketed container to permit the discharge of the ice. This container should be heated to no more than about 40°F, and that will release the ice quickly. The refrigerant remains in the can when it is returned to the upright position and is immediately drawn off and recirculated to the cooling tower. Notice that the cold refrigerant that was put into the warm refrigerant system when the can was pivoted to the emptying position helps maintain a low temperature differential.

It will be understood that various changes in the details, materials and arrangement of parts which have been herein described and illustrated in order to explain the nature of this invention may be made by those skilled in the art within the principle and scope of the invention as expressed in the following claims.

It will further be understood that the "Abstract of the Disclosure" set forth above is intended to provide a non-legal technical statement of the contents of the disclosure in compliance with the Rules of Practice of the United States Patent Office, and is not intended to limit the scope of the invention described and claimed herein.

What is claimed is:

1. An apparatus for making ice under atmospheric conditions, comprising in combination:

a. refrigeration means for reducing the temperature of a refrigerant to atmospheric temperature;

b. a container having a jacket and an opening for the discharge of ice formed within the container;

c. water input means for introducing water into the container at controlled conditions;

d. refrigerant circulation means connected to said refrigeration means and to said jacket for circulating refrigerant through the jacket to cause water in said container to freeze into ice;

e. ice discharge means for effecting the discharge of ice from said container, comprising warm refrigerant means connected to the jacket of said container to introduce warm refrigerant under controlled conditions into said jacket and thereby cause the temperature of the container to rise to a point wherein the ice will part from the container so that it is released and can be discharged therefrom; and f. mounting means connected to said container for supporting the container in an upright position with the opening at the top and for allowing the container to be pivoted to a position which will allow ice to be discharged therefrom under the influence of gravity; said mounting means having passages therethrough in fluid flow communication with said jacket; said refrigeration means and said warm refrigerant means being connected to said passage means in said mounting means for introduction of refrigerant therethrough to the jacket of said container; said connections being such that refrigerant at atmospheric temperature can pass through said mounting means and said jacket in the upright position of said container and upon movement of said container to the position wherein said ice can be discharged therefrom by gravity, warm refrigerant can be introduced through said mounting means and into the jacket of said container; and slip rings are provided connected to the refrigeration means and the warm refrigerant means and engaging the ends of trunnions which form part of said mounting means; said trunnions having said passages therethrough communicating with said jacket; said passages terminating in a port in each trunnion communicating alternatively with the refrigeration means and the warm refrigerant means to provide the fluid flow characteristics aforesaid.

2. An apparatus for making ice under atmospheric conditions, comprising in combination:

a. refrigeration means exposed to the atmosphere and coacting therewith to utilize atmospheric conditions for reducing the temperature of a refrigerant to atmospheric temperature;

b. a container having a jacket and an opening for the discharge of ice formed within the container;

c. water input means for introducing water into the container at controlled conditions;

d. refrigerant circulation means connected to said refrigeration means and to said jacket for circulating refrigerant through the jacket to cause water in said container to freeze into ice; and e. ice discharge means for effecting the discharge of ice from said container, comprising release means for releasing the ice from the container and positioning means for positioning the jacketed container so that the released ice will fall by gravity from the container, said positioning means comprising pivotal means attached to the container to allow it to be pivoted through an arc from an upright position to the position wherein the ice can be discharged by gravity; and motor means are provided for pivoting the container as aforesaid, said motor means being controlled automatically by sensor means which senses when the ice within the container is formed; said sensor means, motor means and positioning means coacting to return the container to an upright position for refilling by said water input means, said water input means and said sensor means coacting to introduce water into said container when said container is in the upright position, to stop the flow of water during the freezing thereof in the container and during the time when the ice is being discharged from the container, and to automatically introduce water into the container when it has again been moved to the upright position.

3. The invention of claim 2 wherein air supply means are provided for introducing an air supply hose and air in the water in said container while the water is being frozen and for automatically removing the air supply hose from the water before the water is frozen; said air supply means coacting with said sensor to perform said functions and to control the flow of air through said hose.

4. An apparatus for making ice under atmospheric conditions, comprising in combination:

a. refrigeration means exposed to the atmosphere and coacting therewith to utilize atmospheric conditions for reducing the temperature of a refrigerant to atmospheric temperature;

b. a container having a jacket and an opening for the discharge of ice formed within the container;

c. water input means for introducing water into the container at controlled conditions;

d. refrigerant circulation means connected to said refrigeration means and to said jacket for circulating refrigerant through the jacket to cause water in said container to freeze into ice; and e. ice discharge means for effecting the discharge of ice from said container, comprising warm refrigerant means connected to the jacket of said container to introduce warm refrigerant under controlled conditions into said jacket and thereby cause the temperature of the container to rise to a point wherein the ice will part from the container so that it is released and can be discharged therefrom; and mounting means are provided connected to said container for supporting the container in an upright position with the opening at the top and for allowing the container to be pivoted to a position which will allow ice to be discharged therefrom under the influence of gravity; said mounting means having passages therethrough in fluid flow communication with said jacket; and said refrigeration means and said warm refrigerant means are connected to said passage means in said mounting means for introduction of refrigerant therethrough to the jacket of said container; said connections being such that refrigerant at atmospheric temperature can pass through said mounting means and said jacket in the upright position of said container and upon movement of said container to the position wherein said ice can be discharged therefrom by gravity, warm refrigerant can be introduced through said mounting means and into the jacekt of said container.

* * * * *